US010079008B2

(12) United States Patent
Suitor

(10) Patent No.: US 10,079,008 B2
(45) Date of Patent: Sep. 18, 2018

(54) MAGNETICALLY SECURED CYMBAL TRIGGER AND CHOKE ASSEMBLY

(71) Applicant: Stephen Suitor, Radcliff, KY (US)

(72) Inventor: Stephen Suitor, Radcliff, KY (US)

(73) Assignee: Rare Earth Dynamics, Inc., Radcliff, KY (US)

( * ) Notice: Subject to any disclaimer, the term of this patent is extended or adjusted under 35 U.S.C. 154(b) by 0 days.

(21) Appl. No.: 15/433,990

(22) Filed: Feb. 15, 2017

(65) Prior Publication Data

US 2017/0229104 A1 Aug. 10, 2017

Related U.S. Application Data

(63) Continuation-in-part of application No. 14/988,570, filed on Jan. 5, 2016, now Pat. No. 9,761,212.

(60) Provisional application No. 62/295,483, filed on Feb. 15, 2016.

(51) Int. Cl.

| | |
|---|---|
| ***G10H 3/14*** | (2006.01) |
| ***G10H 1/055*** | (2006.01) |
| ***G10D 13/02*** | (2006.01) |

(52) U.S. Cl.

CPC ..... *G10H 1/0558* (2013.01); *G10D 13/024* (2013.01); *G10H 3/143* (2013.01); *G10H 3/146* (2013.01); *G10H 2220/561* (2013.01)

(58) Field of Classification Search

CPC ..... G10D 13/024; G10H 3/146; G10H 3/143; G10H 2220/561; G10H 1/0558; G10H 3/18; G10H 3/183; G10H 3/186; G10H 2220/525; G10H 2230/305

USPC ..... 84/627, 730

See application file for complete search history.

(56) References Cited

U.S. PATENT DOCUMENTS

| | | | | |
|---|---|---|---|---|
| 1,915,858 A | | 6/1933 | Miessner | |
| 2,239,985 A | | 4/1941 | Benioff | |
| 2,293,372 A | | 8/1942 | Vasilach | |
| 3,725,561 A | * | 4/1973 | Paul | G10H 3/146 381/118 |
| 4,184,399 A | | 1/1980 | Zuniga | |
| 5,134,920 A | * | 8/1992 | Clark | G10H 3/146 84/477 R |
| 5,142,961 A | | 9/1992 | Paroutaud | |
| 5,168,117 A | | 12/1992 | Anderson | |
| 5,315,060 A | | 5/1994 | Paroutaud | |
| 5,401,900 A | | 3/1995 | Lace | |
| 5,449,964 A | * | 9/1995 | Snyder | G10H 1/0556 310/327 |

(Continued)

FOREIGN PATENT DOCUMENTS

| | | |
|---|---|---|
| JP | H03146385 | 6/1991 |
| JP | 11-173876 | 7/1999 |

(Continued)

*Primary Examiner* — Jeffrey Donels

(74) *Attorney, Agent, or Firm* — Duncan Galloway Egan Greenwald, PLLC; Kevin T. Duncan

(57) ABSTRACT

An apparatus, system, and method for a magnetically and releaseably attachable trigger for an instrument is provided along with a choking device for use of the trigger in connection with a cymbal or like percussion device. The trigger and securing device are disposed on either side of a cymbal surface or a cymbal stand via magnetic force and the choking mechanism is in electrical connection with the trigger to interrupt the signal for choking purposes and is mounted on a surface of the cymbal to be choked.

19 Claims, 14 Drawing Sheets

(56) References Cited

U.S. PATENT DOCUMENTS

| | | | | |
|---|---|---|---|---|
| 5,484,958 | A | 1/1996 | Ogawa | |
| 5,637,823 | A | 6/1997 | Dodge | |
| 5,723,805 | A | 3/1998 | Lacombe | |
| 5,744,744 | A | 4/1998 | Wakuda | |
| 5,811,709 | A * | 9/1998 | Adinolfi | G10D 13/024 84/723 |
| 5,934,629 | A | 8/1999 | Peritz | |
| 6,723,911 | B2 | 4/2004 | Muramatsu et al. | |
| D497,935 | S * | 11/2004 | Kamijima | D17/22 |
| 6,888,057 | B2 | 5/2005 | Juszkiewicz et al. | |
| 7,105,731 | B1 | 9/2006 | Riedl | |
| 7,323,632 | B2 | 1/2008 | Wachter | |
| 8,410,348 | B1 | 4/2013 | Hsieh | |
| 8,729,378 | B2 | 5/2014 | Ryan | |
| 8,916,763 | B2 | 12/2014 | Tetsuro | |
| 9,761,215 | B2 | 9/2017 | Sutton | |
| 2002/0056358 | A1 | 5/2002 | Ludwig | |
| 2003/0161493 | A1 * | 8/2003 | Hosler | G10H 3/146 381/353 |
| 2004/0134332 | A1 * | 7/2004 | Kamijima | G10H 3/146 84/411 R |
| 2005/0039593 | A1 * | 2/2005 | Wachter | G10H 3/146 84/730 |
| 2005/0087019 | A1 | 4/2005 | Face | |
| 2011/0116634 | A1 * | 5/2011 | Norman | H04L 9/3247 380/277 |
| 2012/0060669 | A1 | 3/2012 | Ryan et al. | |
| 2012/0118130 | A1 | 5/2012 | Field | |
| 2013/0047826 | A1 * | 2/2013 | Wissmuller | G10H 3/00 84/723 |
| 2013/0125735 | A1 | 5/2013 | Mori | |
| 2013/0333545 | A1 * | 12/2013 | Dunwoodie | G10H 3/181 84/726 |
| 2014/0053713 | A1 | 2/2014 | Truchses | |
| 2014/0208926 | A1 * | 7/2014 | Shepherd | G10D 13/021 84/730 |
| 2015/0143979 | A1 | 5/2015 | Field | |
| 2015/0262567 | A1 * | 9/2015 | Truchsess | G10H 1/32 84/725 |
| 2016/0210941 | A1 | 7/2016 | Suitor | |
| 2016/0247492 | A1 * | 8/2016 | Field | G10D 13/024 |

FOREIGN PATENT DOCUMENTS

| | | |
|---|---|---|
| JP | 2007-211513 | 8/2007 |
| JP | 2007211513 | 8/2007 |
| JP | 3146385 | 10/2008 |
| JP | 2009-93199 | 4/2009 |

* cited by examiner

Two strip scenario one positive one negative when touching cause a momentary short across
The shared connection Single Touch or Sensing strip Scenario or FSR the pressure on the FSR is registering a choke

MAGNETICALLY SECURED CYMBAL TRIGGER AND CHOKE ASSEMBLY

CROSS REFERENCE TO RELATED APPLICATIONS

The present application claims benefit of priority to U.S. Provisional Patent Application 62/295,483, entitled MAGNETICALLY SECURED CYMBAL TRIGGER AND CHOKE ASSEMBLY (Suitor), filed Feb. 15, 2016, and to U.S. Utility patent application Ser. No. 14/988,570, entitled MAGNETICALLY SECURED INSTRUMENT TRIGGER (Suitor), filed Jan. 5, 2016 (the "'570 patent"), both of which are incorporated by reference herein in their entirety.

FIELD OF THE INVENTION

The field of the invention is electronic instrument triggers and more particularly to triggers for use with cymbals and percussion instruments.

BACKGROUND

The background description includes information that may be useful in understanding the present invention. It is not an admission that any of the information provided herein is prior art or relevant to the presently claimed invention, or that any publication specifically or implicitly referenced is prior art.

In the past few decades, drum triggers have increasingly been used with acoustic drums for live performances and studio recordings. In many instances, drum triggers can overcome potential problems with using microphones and can allow a drummer to have more control over the sound of the drum. In effect, the addition of a drum trigger to an acoustic drum converts the acoustic drum to an electric drum pad.

The '570 patent is directed to a new and improved drum trigger that addresses the problems associated with the prior art as discussed in the Background of that application.

In addition to drum instruments, drummers use a variety of cymbal and related instruments that also require triggering in the context of a complete electronic drum kit solution. Prior attempts to trigger cymbals suffer due to poor mechanisms and manners of attaching the trigger device to the cymbal. Often these devices suffer from ineffective sensitivity due to mounting method used or to failure of the mounting method and loss of triggering altogether or need to re-attach trigger to the cymbal. Repeated failures are not only undesired but also cause the devices to degrade over time requiring replacement thus adding to cost.

US Pat. App. Publication 2012/0118130, ELECTRONIC CYMBAL ASSEMBLY WITH MODULAR SELF-DAMPENING TRIGGERING SYSTEM, (Field) discloses a "choke system to stop triggering . . . basically as an on and off switch" for use with a hi-hat type cymbal instrument wherein "when one hits the choke it will trigger a sound that is sent to the sound module, so that a computer associated with the sound module will basically tell the sound system to shut off." The Field set up "includes a trigger system that uses half of the surface area of the cymbal and is attached by nuts and bolts." A complicated variable resistor riding in a sleeve co-axially with the plunger and clutch mechanism of the hi-hat is required to accomplish the triggering of the Field system.

U.S. Pat. No. 7,323,632, PERCUSSION TRANSDUCER, (Wachter) discloses use of a center-axis piezo transducer mounted between the center mounting hole of a cymbal and a washer along a cymbal mount spindle. The '632 patent specifically teaches away from a non-center-axis located transducer of FIG. 6 due to "making the striking surface unbalanced, thus causing undesired rotation after repetitive strikes." A FSR-based choke is briefly mentioned as a "pressure sensitive tape switch or . . . FSR . . . attached around the circumference of the striking surface providing a method to 'choke' the initial sound triggered by the percussion transducer."

Thus, there is a need for improved cymbal triggers and chokes associated with full and enjoyable use of cymbal triggers.

SUMMARY OF THE INVENTION

The present invention provides apparatus, systems, and methods in which a drum trigger has a first member, which may be a securing device, and a second member, which may be a trigger, which go on either side of a cymbal. The securing device can magnetically couple to the trigger, such that the cymbal surface is interposed between the securing device and the trigger. This configuration allows the trigger to non-concentrically attach directly to the cymbal without modifying or damaging the cymbal with without disassembly and without the need for nuts and bolts. The choke of the present invention is attached partially about the circumference of a portion of the cymbal and provides an electrical means for interrupting or choking the sound associated with the trigger device based on the signal communicated to the sound module. The choke may be used on either a plastic cymbal, such as typically used for practice or for e-drum kit set up and may also be used with traditional metallic cymbals.

The trigger securing device magnets are preferably of the rare-earth element type, such as neodymium magnets. The drum trigger further comprises a sound-receiving element, such as a piezoelectric transducer, which translates the vibrations of the cymbal when played into a digital or analog electrical signal such as by a sound module commonly associated with electronic drum equipment. The sound-receiving element, (e.g. piezoelectric transducer) is electrically coupled to an analog or digital sound management system. In some embodiments, the digital sound management system is a drum sound module, and the piezoelectric transducer is connected to the drum sound module via a TRS jack.

The cymbal trigger and choke assembly of the present invention is advantageous over prior art cymbal trigger devices because it is more accurate, more durable, and easier to use than the prior art trigger devices. The cymbal trigger of the present invention is magnetically secured to the cymbal. This enables the trigger to move with the vibrations of the cymbal on which it is disposed while capturing the exact vibrations and tone of the instrument while avoiding "bounce" or double triggering or cross-triggering.

In this manner the present invention provides the following exemplary advantages over the prior art: Instantly provides dampening for quiet play consistent with electronic cymbals; No alteration to cymbals; Provides muting ability/retro fit e-cymbals without capability; With mute/dampener our trigger can be used as single source for typical trigger setup on drum kit.

In a first exemplary embodiment, the present invention provides A choke and trigger apparatus, the trigger being magnetically mounted to a cymbal or cymbal stand and used to generate a signal derived from a vibration detected upon a user operating a cymbal, the choke and trigger apparatus comprising: a trigger adapted to be removably mounted onto a cymbal or cymbal stand and comprising: a housing; a magnet disposed and secured within the housing and adapted to removably secure the trigger to the cymbal or cymbal stand; a piezo-electric transducer having an electrical output and being disposed within the housing, the piezo-electric transducer being essentially electrically and physically isolated from the magnet and adapted to generate an electrical signal in response to a detected mechanical vibration associated with operation of the cymbal; a choke adapted to be mounted onto the cymbal or cymbal stand and to sense a touch of a hand for interrupting a signal associated with the electrical signal, the choke comprising: a sensor disposed on the cymbal and adapted to sense the touch of a user operating the cymbal; means to cause an electrical response to the sensed touching.

In addition the invention may be further characterized as follows: comprising a securing device, the securing device comprising a second housing and a second magnet disposed within the second housing, whereby with the trigger disposed opposite the securing device the respective magnets are attracted to each other with the cymbal disposed between the trigger and the securing device; further adapted to deliver the electrical signal to an input of an electronic drum module, the electronic drum module being adapted to process the trigger electrical signal and produce an audio signal representative of a sound associated with operation of a musical instrument; further comprising an electrical combination device adapted to be electrically connected to the trigger and to the choke and to generate an output representing the trigger electrical signal as unchoked and as choked; wherein the trigger magnet is a type of rare earth magnet; further comprising an electrical lead having a tip-ring-sleeve (TRS) jack, XLR connector, or other suitable connector with a termination adapted to operatively connect to an electronic module; and wherein the choke comprises a Force-Sensing Resistor sensor.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Figure 1:
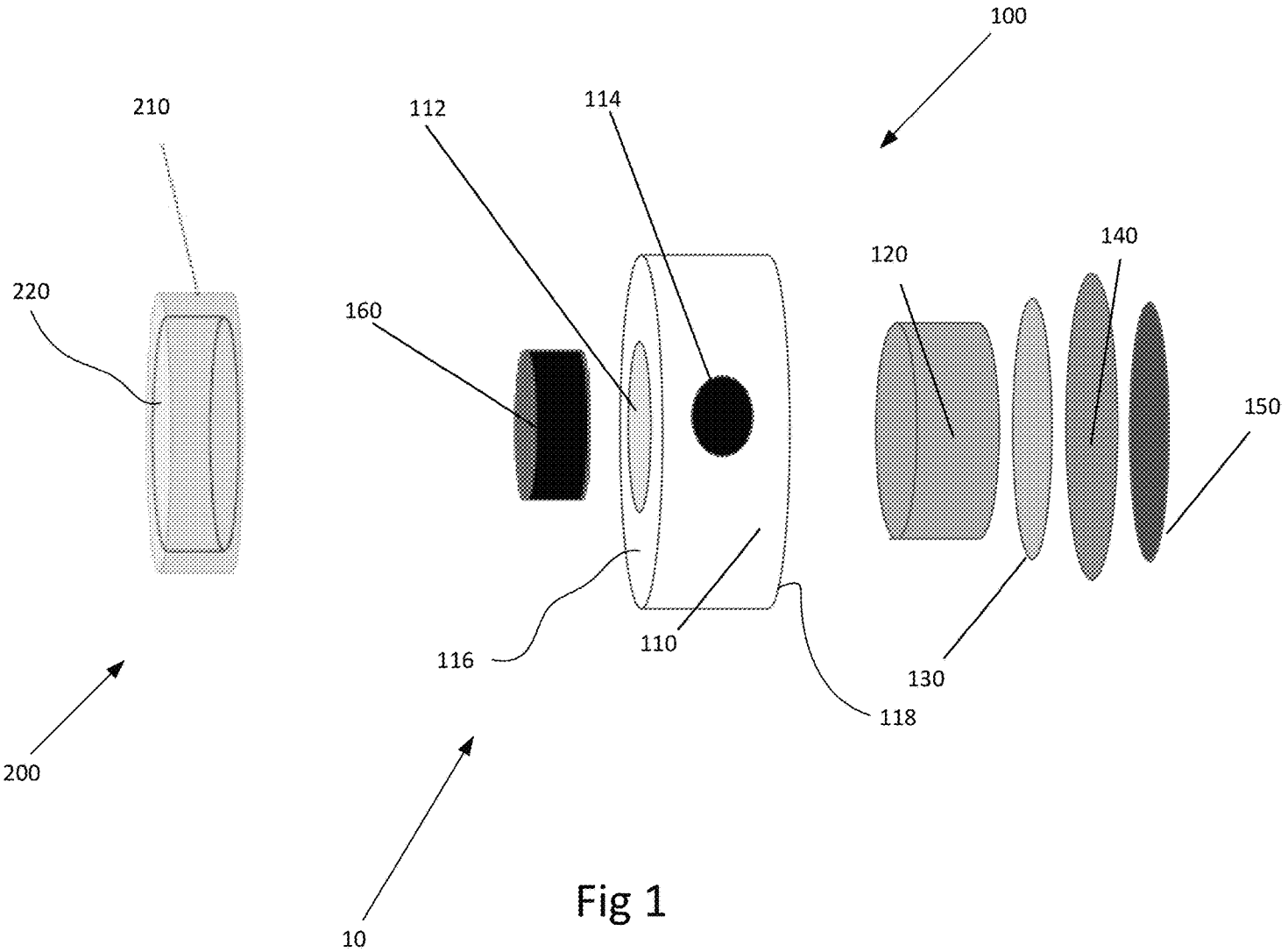
FIG. 1 provides a side view of the component parts of a trigger system according to the present invention.

With reference to FIG. 1, a side view of the primary component parts of a trigger system 10 according to one embodiment of the present invention is provided. The trigger system 10 comprises a trigger 100 and a securing device 200. The trigger 100 comprises a housing body 110 being substantially hollow and having an opening 112 at the top 116, and being substantially open at the bottom 118. The housing body 110 also has a pass-through opening 114 on the side of the housing. Magnet 120 is disposed within the housing body 110 and may be secured to the housing body 110 by an adhesive such as an epoxy or by a set of securing tabs. Silicone buffer layer 130 is disposed between the magnet 120 and the piezoelectric transducer 140. Piezoelectric transducer 140 is disposed at the bottom of the housing body 110 and may sit in a lip, ridge, or indentation at the bottom of the housing and may be secured by an adhesive such as an epoxy. Silicone buffer layer 150 is disposed on the exterior of the bottom 118 of the housing 110.

The housing body 110 of the trigger 100 may be substantially cylindrical, cuboid, or any other suitable shape. The top 116 of the housing may not have opening 112 and may instead be flat and covered in a buffer layer composed of silicone, foam, foam-rubber, or other suitable material. In a preferred embodiment, the silicone buffer layer 130 and silicone buffer layer 140 will comprise a thin layer of silicone secured in the housing body 110 by an adhesive such as an epoxy. However, the silicone buffer layer 130 and silicone buffer layer 140 may also be secured directly to the magnet 120 and piezoelectric transducer 140 respectively. The silicone buffer layer 130 is adapted to provide a physical and electrical barrier between the magnet 120 and piezoelectric transducer 140, and may comprise any other suitable material such as rubber or foam. The silicone buffer layer 150 is adapted to provide a non-skid and impact resistant layer on the bottom 118 of the trigger housing 110, and may comprise any other suitable material such as rubber or foam. The silicone buffer layer 150 keeps the trigger 100 from sliding or shifting from its position even when the trigger 100 is subjected to intense vibrations. Grommet 160 is adapted to fit within the opening 112 on the top 116 of the housing 110, and may comprise a material such as rubber, silicone rubber, or similar suitable elastic material. The grommet 160 may have an opening and may be adapted to fit on and/or receive a lug, screw, or other similar protrusion. The magnet 120 in the trigger 100 may be a neodymium or similar rare earth magnet, which are strong permanent magnets made from alloys of rare earth elements, with suitable Gaussian pull strength, e.g. at least 2500 Gauss. The magnet 120 may comprise the following technical specifications: 20 mm diameter×5 mm thick (0.79" diameter×0.20" thick); material: Neodymium (NdFeB); grade: N48; coating: Nickel (Ni); magnetization: through thickness; and pull force: 19.68 pounds. The magnet 120 is adapted to releaseably and magnetically secure the trigger 100 to a ferrous or magnetic structure such as in the securing device 200. However, in some embodiments the magnet 120 may simply be a magnetically attractive plate or disk instead of a magnet and may be attracted to a magnet 220 in the securing device, or vice versa.

The securing device 200 comprises a housing 210 having an opening adapted to receive a magnet 220. Securing device 200 may also be a magnet 220 without housing 210 and having a coating such as a rubberized coating or an impact-resistant gel coating, such as plastic, plastic blend, rubber, rubber blend, or other suitable impact-resistant material. Similarly, the magnet 120 in the trigger 100 may also have a coating such as a rubberized coating or an impact-resistant gel coating, such as plastic, plastic blend, rubber, rubber blend, or other suitable impact-resistant material. The securing device 200 may also have an additional buffer layer on the bottom of the securing device 200 that may be comprised of silicone, rubber, or other suitable material. If used, this layer would aid in keeping the securing device in place and in magnetic attraction with the trigger 100.

The piezoelectric transducer 140 may also be any suitable sound-receiving unit capable of translating a mechanical signal (e.g. vibration of the drumhead) into an electrical (analog or digital) sound signal. The piezoelectric transducer 140 may have the following technical specifications: plate diameter: 27 mm (1.06 inches); element diameter: 20 mm (0.787 inches); plate thickness: 0.54 mm (0.021 inches); lead length: ~50 mm (1.96 inches); plate material: brass; resonant frequency (kHz): 4.6+/−0.5 kHz; resonant impedance (ohm): 300 maximum; and capacitance (nF): 20.0+/−30% [1 kHz].

Figure 4:
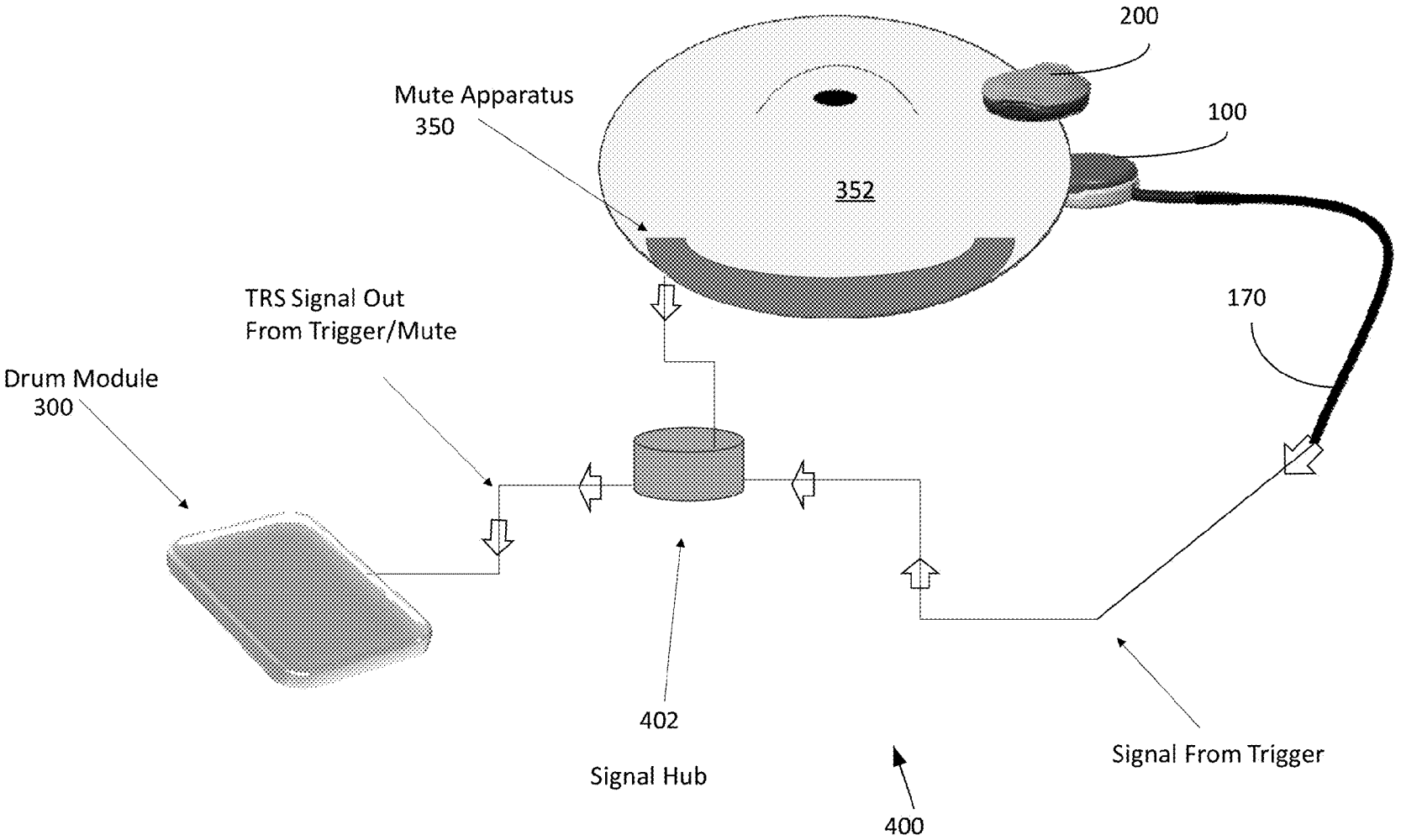
FIG. 4 provide side and top views respectively of a trigger with electrical lead according to the present invention.

In one embodiment, the transducer 140 may instead be a force sensing resistor ("FSR") capable of producing differing voltages as force is applied to the sensor. Many modules, such as drum module 300 shown in FIG. 4, are not capable of using the output of an FSR. Furthermore, an FSR may not produce the desired outputs with similar accuracy and responsiveness compared to a piezoelectric transducer. However, the use of an FSR instead of a piezoelectric transducer 140 may be desirable in some applications. In some embodiments, the trigger system 10 is adapted to be mounted on a drum head in a "Thru-Head" configuration, shown in FIG. 24, a drum lug in a "Thru-Lug" configuration, shown in FIGS. 25-28, a drum shell in a "Thru-Shell" configuration, shown in FIG. 29, on a cymbal, shown in FIG. 30, on a cymbal stand, shown in FIGS. 31-35, or on another acoustic instrument, shown in FIGS. 36-37. The trigger system 10 may also be employed, placed, or installed by way of the magnet 120 or secured by the securing device 200 to translate a mechanical signal into an electrical signal in other suitable applications. The trigger 100 may also comprise a potentiometer or a resistor to provide an adjustment or resistance to the trigger 100 on the trigger 100 itself.

The use of rare earth magnets on the top in the securing device 200 and bottom in the trigger 100 of a drumhead provides a superior ability to capture and transfer vibrations from the playing surface to a piezoelectric transducer 140 regardless of the size of the drum. The strength of the magnets 120 and 220 also provides a dampening effect that makes it ideal for both electronic and hybrid drums with no permanent alterations to the drum. Additionally, by being magnetically attached, the trigger 100 may vibrate along with the surface or instrument on which it is attached without affecting the sound, tone, or timbre of the instrument. Floating also enables the trigger 100 to be far more sensitive than traditional drum triggers. Being magnetically attachable also enables the trigger 100 to be placed anywhere desired by the musician or user. Additionally, because the trigger 100 may be disposed within a drum or other instrument, the trigger is not likely to be damaged from being struck or impacted in normal use or operation as the only electronic components are inside the instrument out of harm's way.

The use of the trigger 100 provides increased frequency response and reduces the likelihood of double triggering, especially when used with a musical instrument. Trigger 100 records a clearer, more defined initial strike and has a more consistent waveform tapering after the initial strike. The waveform length is shorter resulting in a shorter decay time. This increases a module's, such as module 300 shown in FIG. 2, ability to capture strikes at short intervals. Additionally, the optimal headroom of the trigger 100 reduces re-triggering and allows reduced threshold settings in the module 300 creating a realistic velocity.

Figure 2:
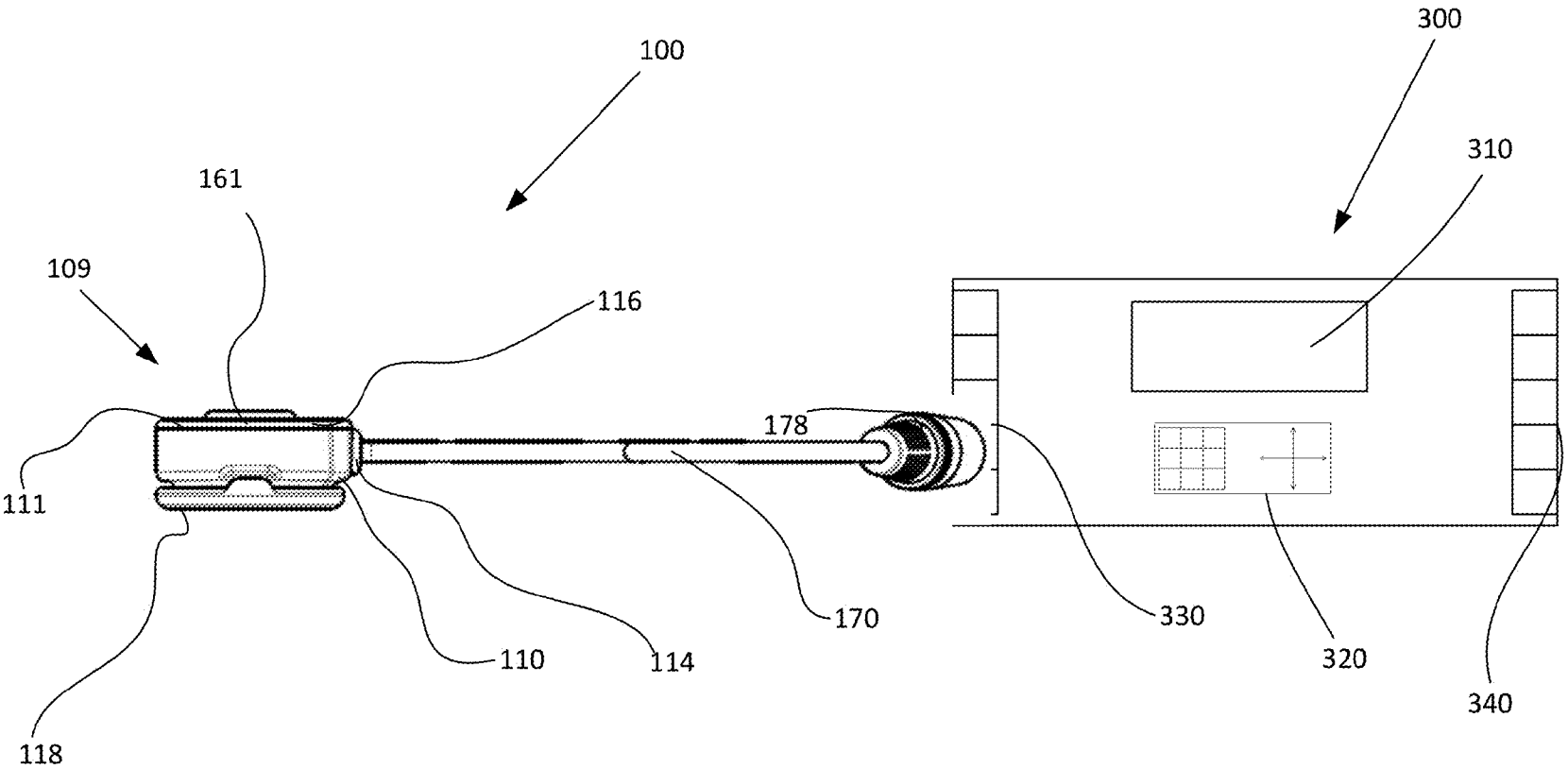
FIG. 2 provides a perspective view of a trigger according to the present invention.

With reference now to FIG. 2, a perspective view of a trigger 100 according to the present invention is provided. The trigger 100 comprises the housing 109, comprising the housing body 110 and magnet plug 111 which has a grommet 161 disposed in the top of the magnet plug 111. In this embodiment of the trigger 100, shown in greater detail in FIGS. 4-6, 9B, and 10-14, the housing body 110 holds the piezoelectric transducer 140 and the magnet 120 is held between the housing body 110 and the magnet plug 111. The trigger 100 therefore comprises a two-piece shell with the primary component of the shell being the housing body 110 and the secondary component of the shell being magnet plug 111. The pass-through opening 114 is adapted to permit an electrical lead 170 to pass through the pass-through opening 114. The electrical lead 170 may have a tip-ring-sleeve (TRS) jack, XLR connector, or other suitable connector at the termination 178 of the electrical lead 170. The termination 170 is adapted to operatively connect to an electronic module 300, which may be a drum module or other suitable audio module.

A drum module 300 may have a display 310, set of controls 320, a set of inputs 330, and a set of outputs 340. The trigger 100 is adapted to connect to the module 300 by way of the electronic lead 170 to an input 330. Configuring the drum module is performed by manipulating the inputs 320 and using the display 310 to view the current configuration and options for the module 310. The module 300 may be connected to additional equipment such as speakers, computers, amplifiers, and additional electronic modules by way of outputs 340 which may comprise universal serial bus (USB) ports, TRS receptacles, XLR female receptacles, RJ-45 jacks, or other suitable connections.

In typical operation, a mechanical signal, e.g. a strike of a drum head or drum shell or cymbal, is translated by the piezoelectric transducer 140 in the trigger 100 into an electrical signal. This electrical signal may comprise a level which may fall on a range of 127 or more levels. This signal is received by the module 300 and the module 300 determines how to interpret the signal. For example, if the trigger 100 is disposed on a drum, and the signal is an electrical representation of the strike of a drum or a cymbal, the module 300 may determine which sound from a library of sounds to output to the outputs 340. The module 300 may also make this determination based on a set of settings used to configure the module. The set of settings may be selected from a library of configurations or settings stored in or loaded onto the module 300. The module 300 may be manipulated by the inputs 320 to fine tune the module to the particular implementation of the trigger 100. These fine tunings may be used to employ a plurality of triggers 100 on a single instrument. The trigger 100 is adapted to be used with a plurality of other triggers 100 to create a set of "zones" on an instrument, e.g. a drum. The trigger 100 does not receive cross-talk interference from other triggers like trigger 100 used on the same instrument, and when used as a set of triggers 100, does not suffer from "hot-spotting" which is the higher sensitivity of particular areas on an instrument such as a drum.

Figure 3:
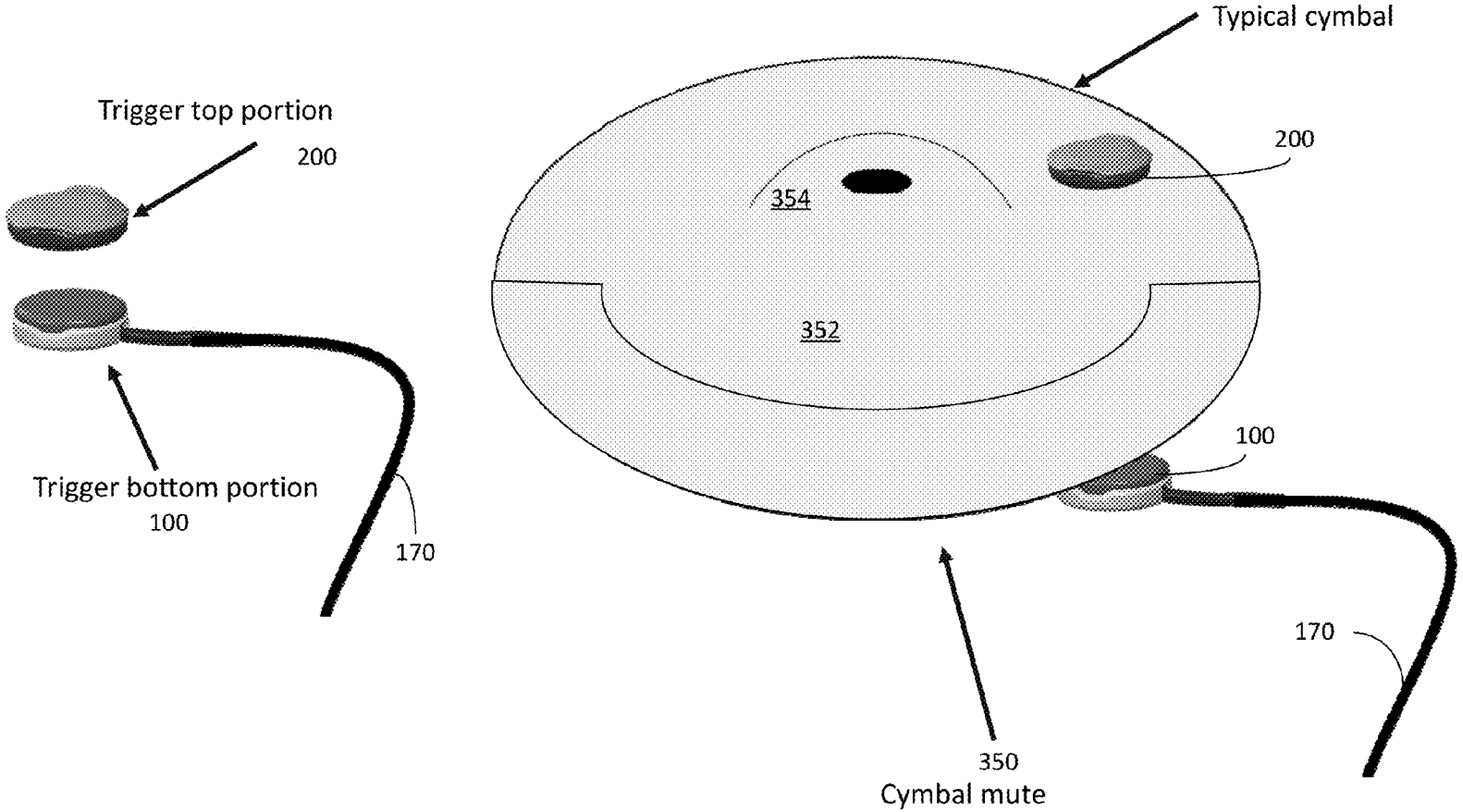
FIG. 3 provide side and perspective views respectively of a trigger with a strain relief according to the present invention.

With reference now to FIGS. 3 and 4, an embodiment of cymbal choke 350 is shown attached to a portion of cymbal 352, which includes a bell portion 354. A trigger assembly 100/200 is shown removably attached to the cymbal 352 by way of magnets as described above. Electrical lead 170 is attached at one termination at piezoelectric transducer of trigger 100 and at another termination at signal hub 402, which provides a TRS output connected to drum module 300.

Figure 5:
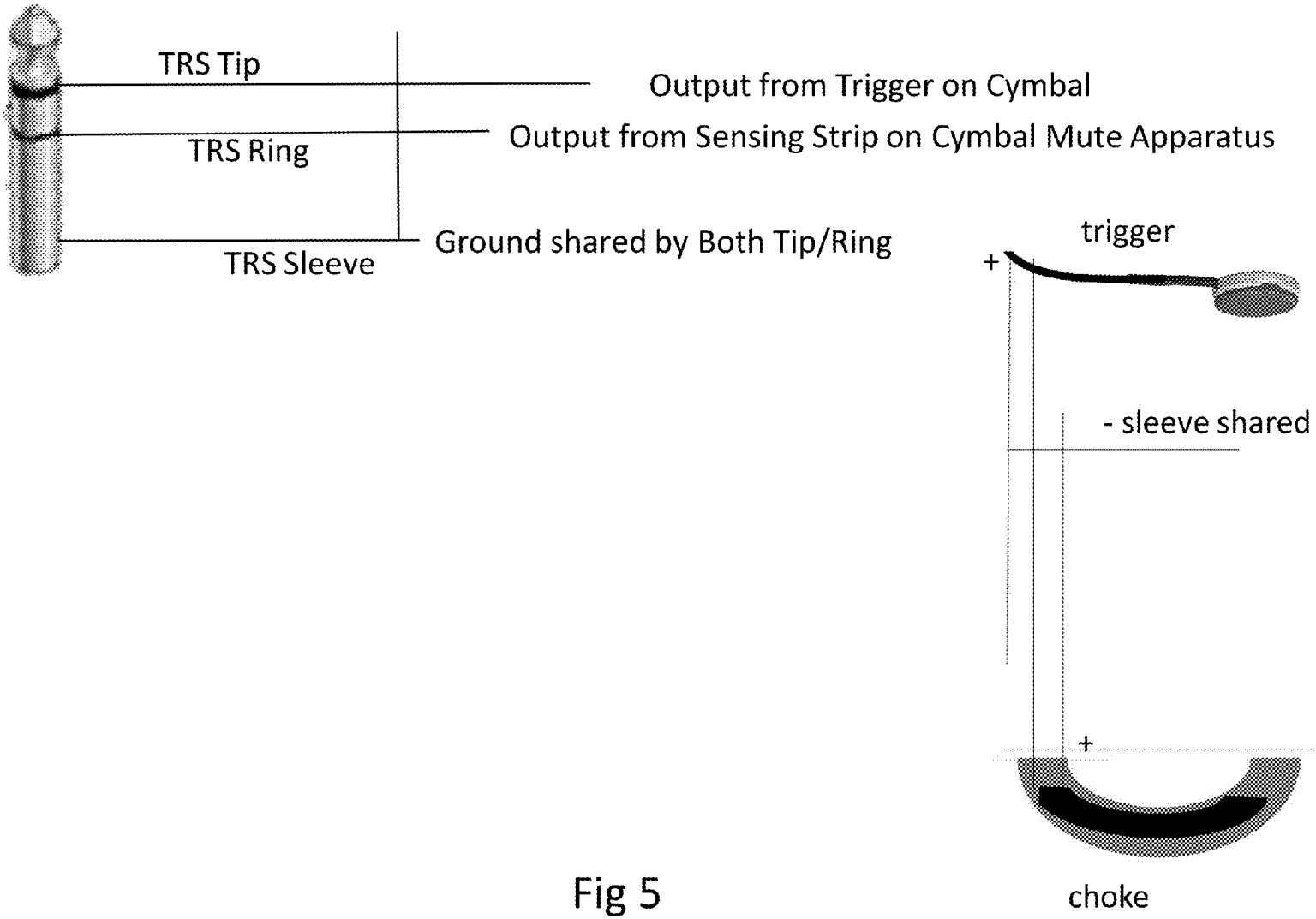
FIG. 5 provides a perspective view of a trigger showing the trigger components according to the present invention.

With reference now to FIG. 5, an exemplary TRS configuration and trigger/mute wiring connection is illustrated for use with the trigger and choke assembly described above. When the sensing strip on the cymbal mute is touched or gripped, it shorts the contact in turn muting the connected trigger.

Figure 6:
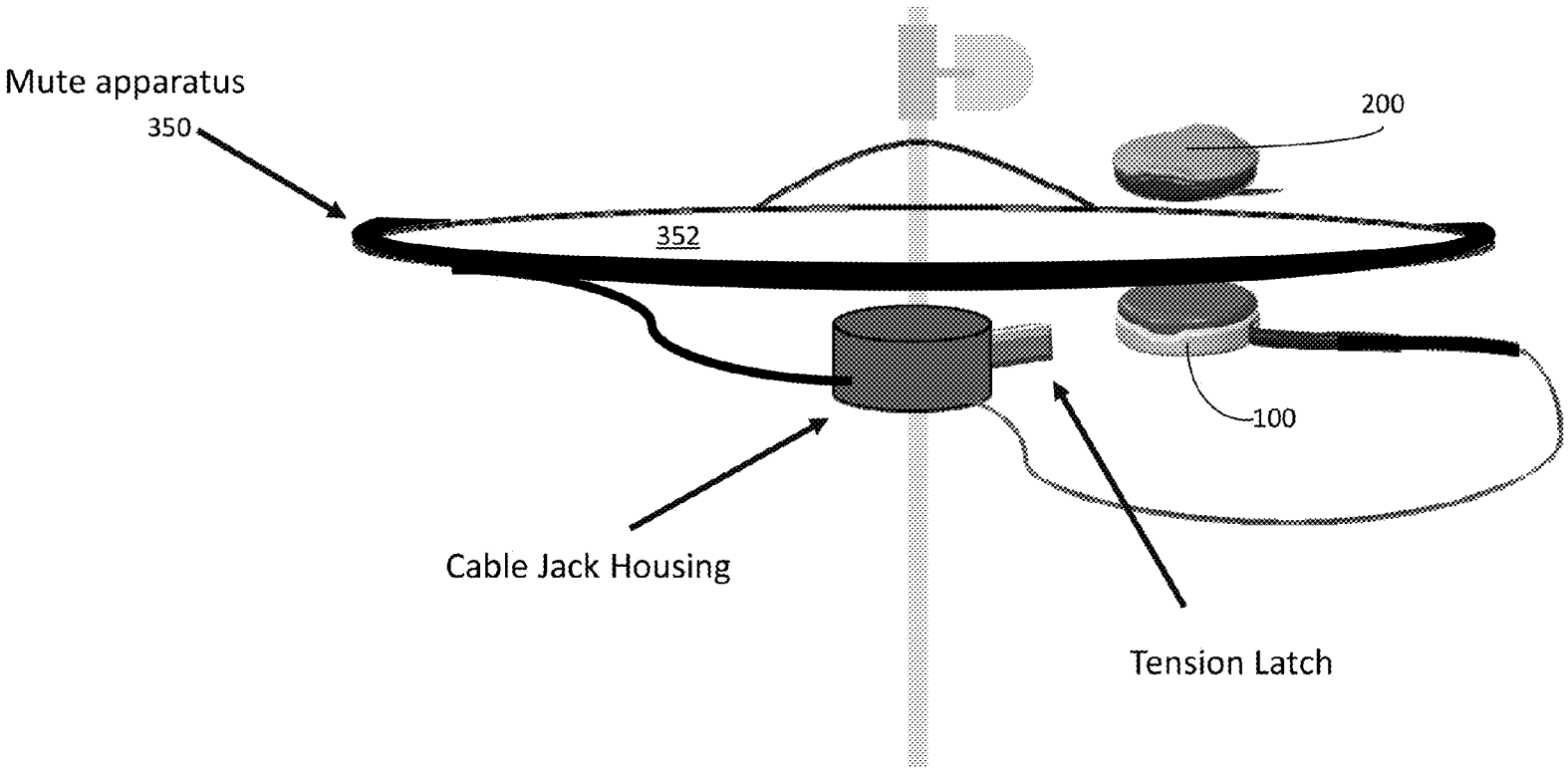
FIG. 6 provides a side view showing the components of a trigger according to the present invention.

With reference now to FIG. 6, an exemplary field set up configuration is illustrated for use with triggering strikes made on cymbal 352 as picked up by trigger 100/200 and interrupted by choke 350. Cable jack housing is provided to receive as inputs the lead terminals for trigger and choke assembly.

Figure 8:
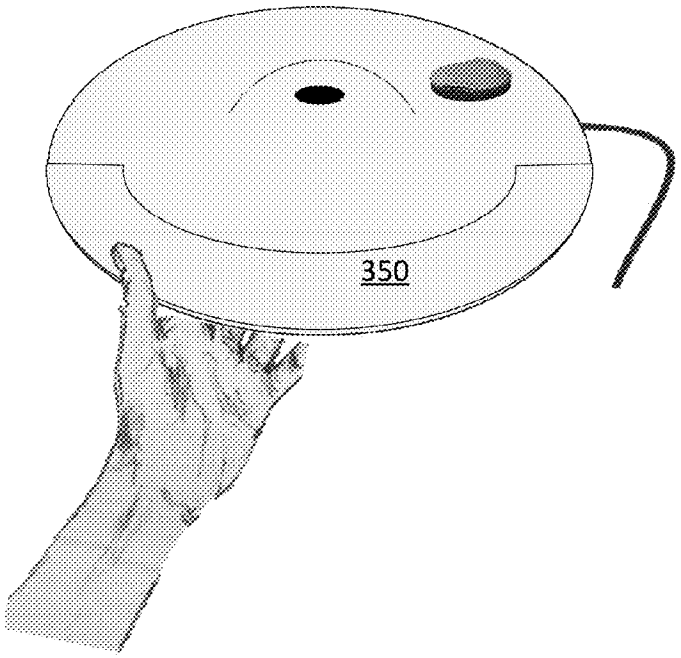
FIGS. 7 and 8 provide side perspective views of cymbal operation having a trigger and choke assembly according to the present invention.
Figure 7:
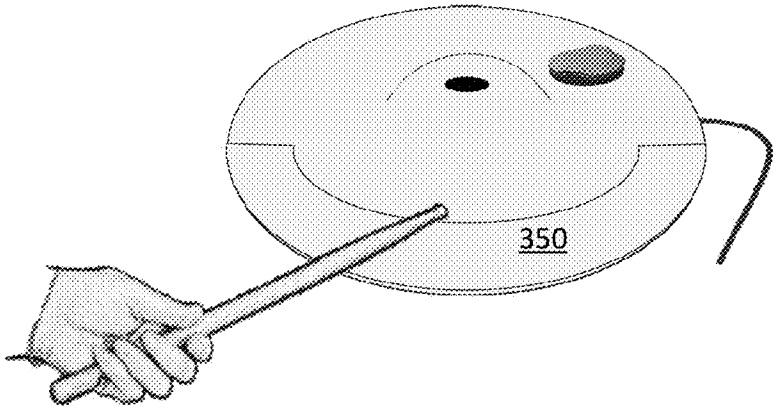

With reference now to FIGS. 7 and 8, an exemplary set of perspective views are shown to illustrate the striking of cymbal 352 (FIG. 7) and then the choking of the cymbal (FIG. 8).

Figure 9:
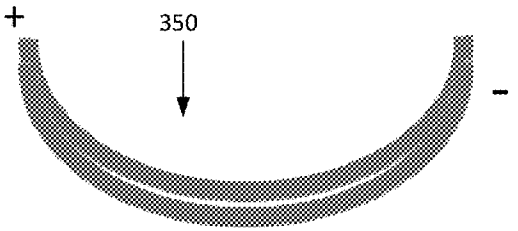
FIGS. 9 and 10 provide side perspective views of an acoustic cymbal, a retainer trim and sensing strip components according to the present invention.
Figure 10:
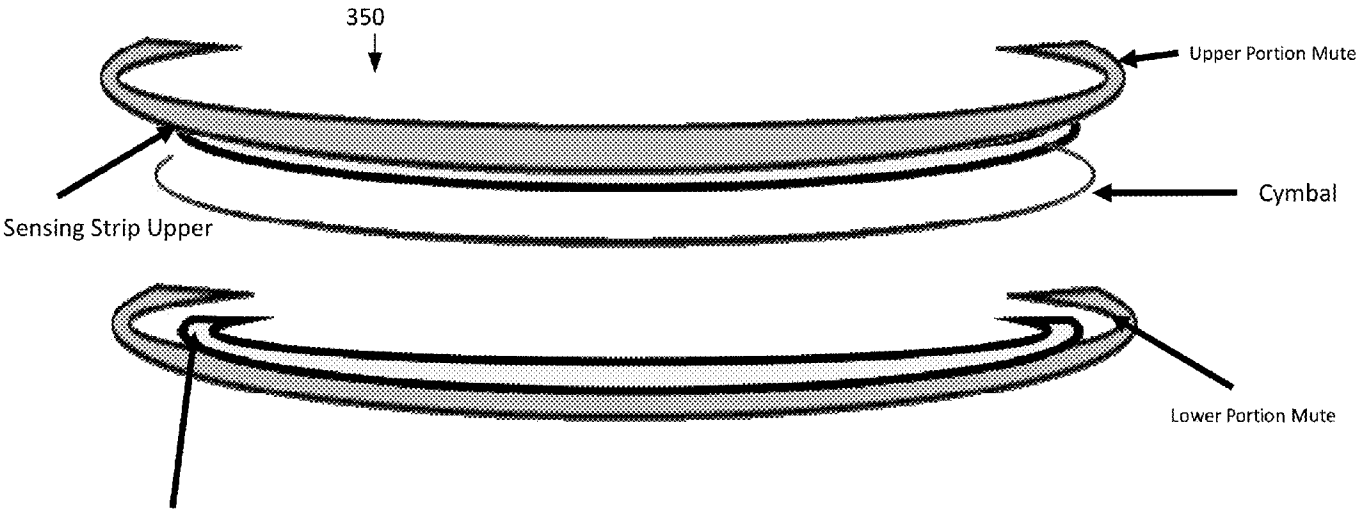
Figure 11:
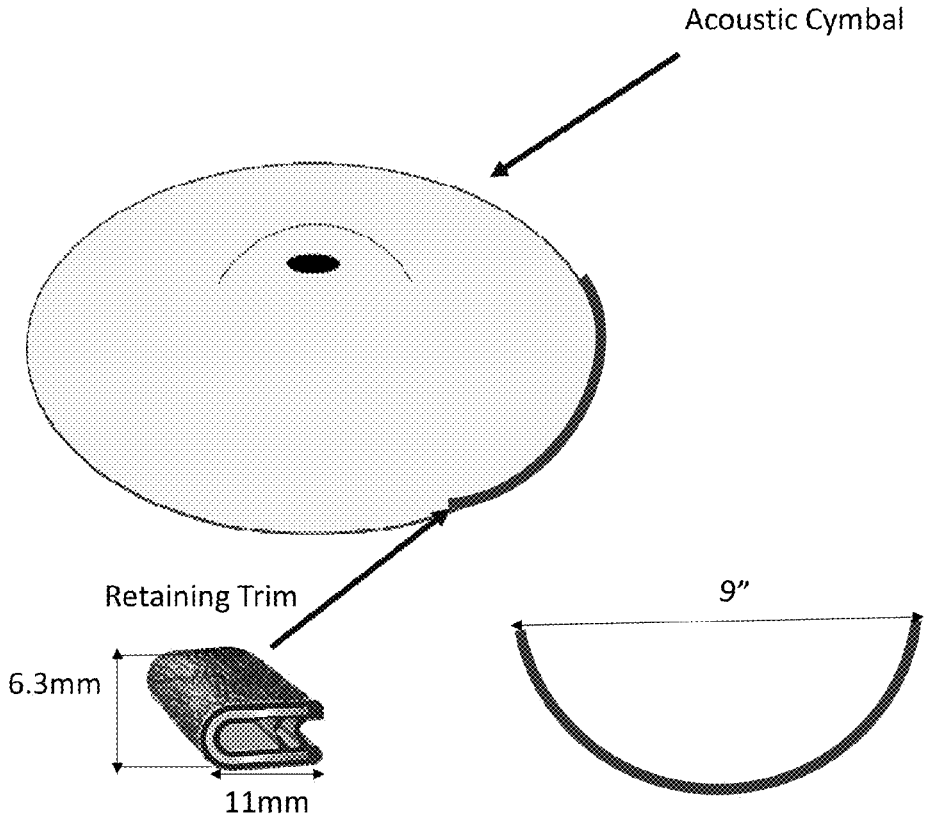
FIGS. 11 and 12 provide side perspective views of a retainer trim and sensing strip components according to the present invention.
Figure 12:
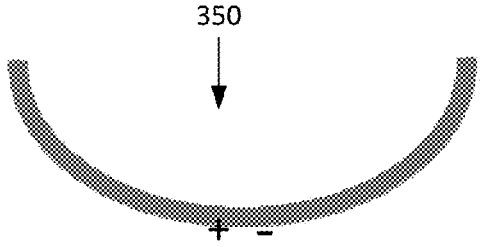
Figure 13:
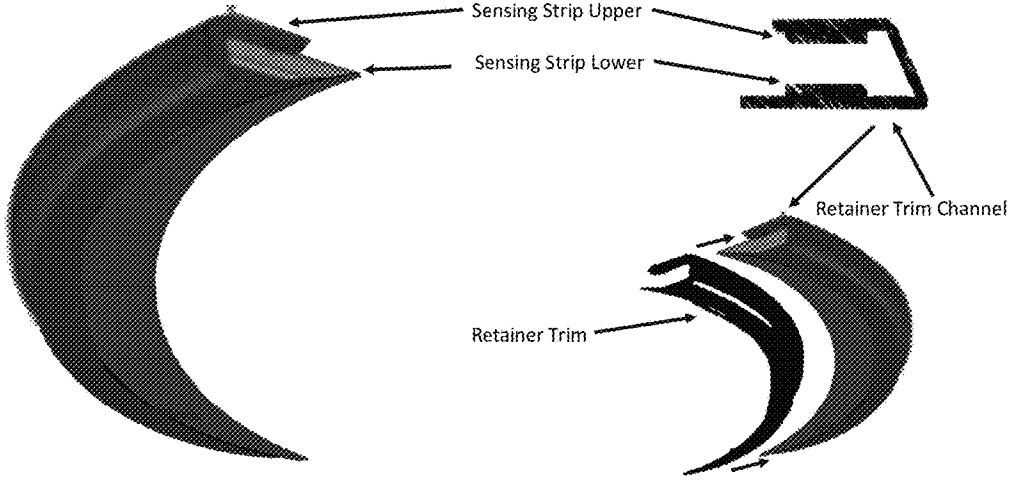
FIGS. 13 and 14 provide side perspective views of a retainer trim and sensing strip components according to the present invention.
Figure 14:
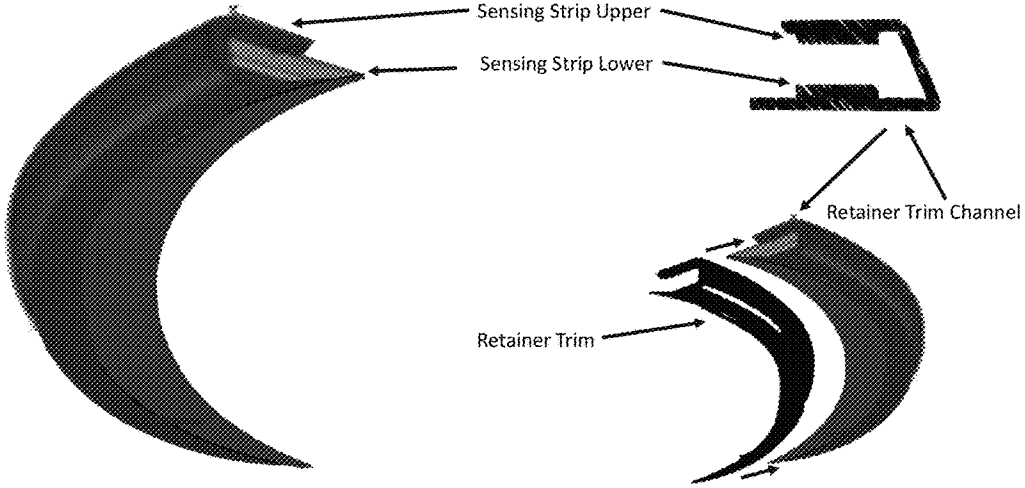

With respect to FIG. 9, exemplary embodiment of choke 350 is shown wherein a two-strip scenario includes one positive and one negative when touching causes a momentary short across the shared electrical connection. With respect to FIG. 10, exemplary embodiment of choke 350 is shown wherein a two-strip scenario includes an upper sensing strip mounted on the top of the cymbal and a lower sensing strip mounted on the lower surface of the cymbal. In one manner, touching causes a momentary short across the shared electrical connection. The pressure sensitive strip may be a Force-Sensing Resistor type sensor or switch, e.g., a material whose resistance changes when a force or pressure is applied. They are also known as "force-sensitive resistor" and are sometimes referred to by the initialism "FSR". See for example, https://en.wikipedia.org/wiki/Force-sensing_resistor.

With reference now to FIGS. 11, 12, 13 and 14, further exemplary embodiments of choke 350 are shown. The configurations as shown illustrate sensing strips and retainer clips. Alternatively, the sensing strip may be embedded into a material applied to the top of a cymbal such as by an adhesive—e.g., choke 350 of FIGS. 7/8.

Figures 15A, 15B:
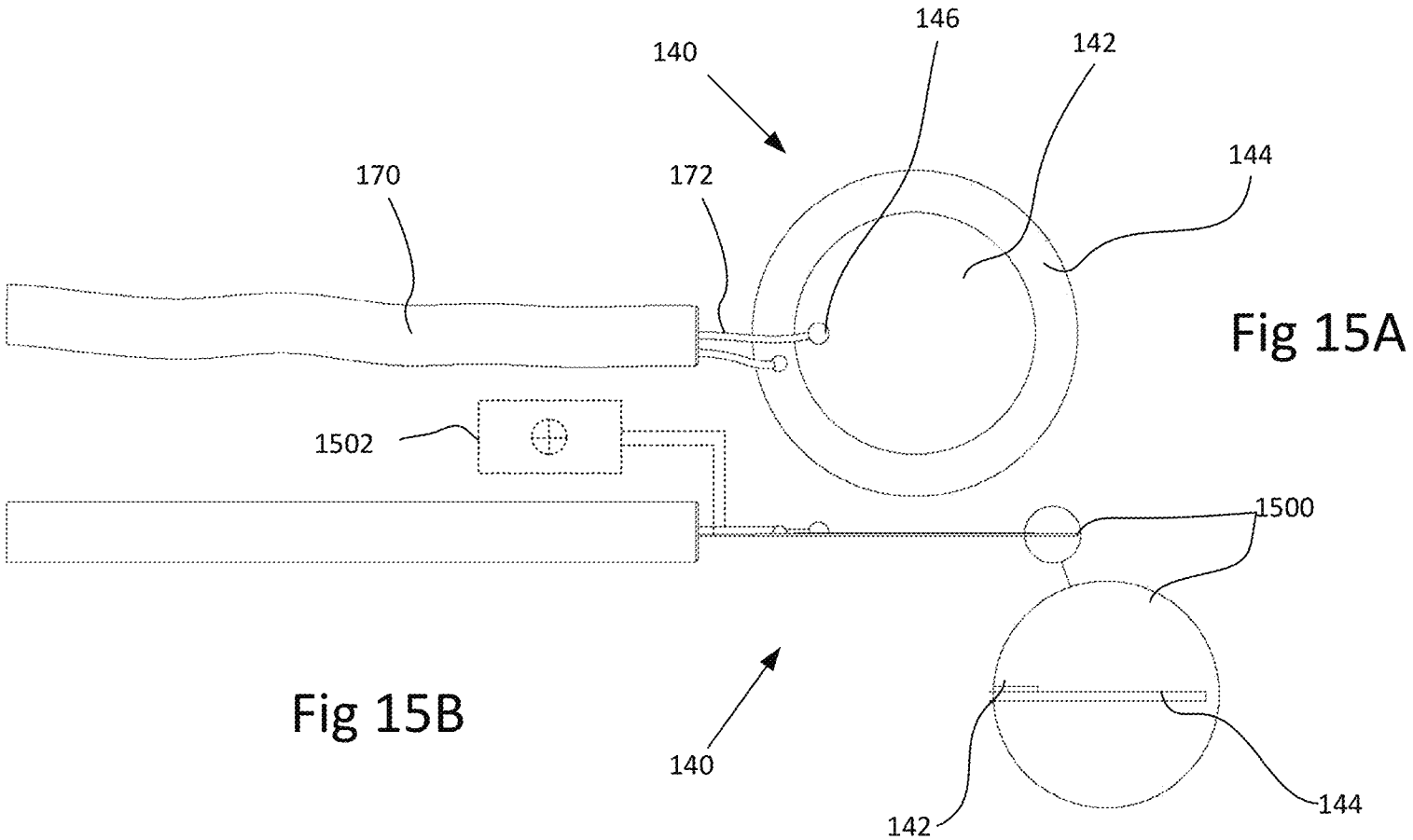
FIGS. 15A and 15B provide plan and side views respectively of a piezoelectric transducer according to the present invention.

With reference now to FIGS. 15A and 15B, plan and side views respectively of a piezoelectric transducer 140 according to the present invention are provided. The electrical lead 170 with set of wires 172 is shown electrically and operatively connected to electrical connections 146 on the bottom portion 144 and top portion 142 of the piezoelectric transducer 140. The top portion 142 may be comprised of ceramic or other suitable material and the bottom 144 may be comprised of brass or bronze or other suitable non-magnetic metal. The material used for the bottom 144 must not be magnetically attractive or the magnet 120 used in the trigger 100 may interfere with the operation of the piezoelectric transducer 140. The inset 1500 shown in FIG. 15 shown the detail of the thickness of the top portion 142 and bottom portion 144 of the piezoelectric transducer 140. The top portion 142 may a have a diameter of 20 mm and be 0.1 mm thick, and the bottom portion may have a diameter of 27 mm and be 0.2 mm thick. When used in a housing such as housing body 110 or housing 111, shown in FIGS. 13A and 13B, the piezoelectric transducer needs to be able to bend and flex to accurately transducer the mechanical inputs into electrical signals. The buffer layers such as layers 130 and 150 shown in FIG. 1 isolate the piezoelectric transducer from the magnet and the surface on which the trigger 100 is placed, but still place the piezoelectric transducer 140 in physical abutment with the surface. Additionally, a potentiometer 1502 may be attached to the wires 172 to enable the output of the piezoelectric transducer 140 to be more finely tuned by adding additional resistance to lower the voltage output.

The choke assembly described above can be used in connection with the trigger embodiments of FIGS. 15A and 15B.

Figure 16:
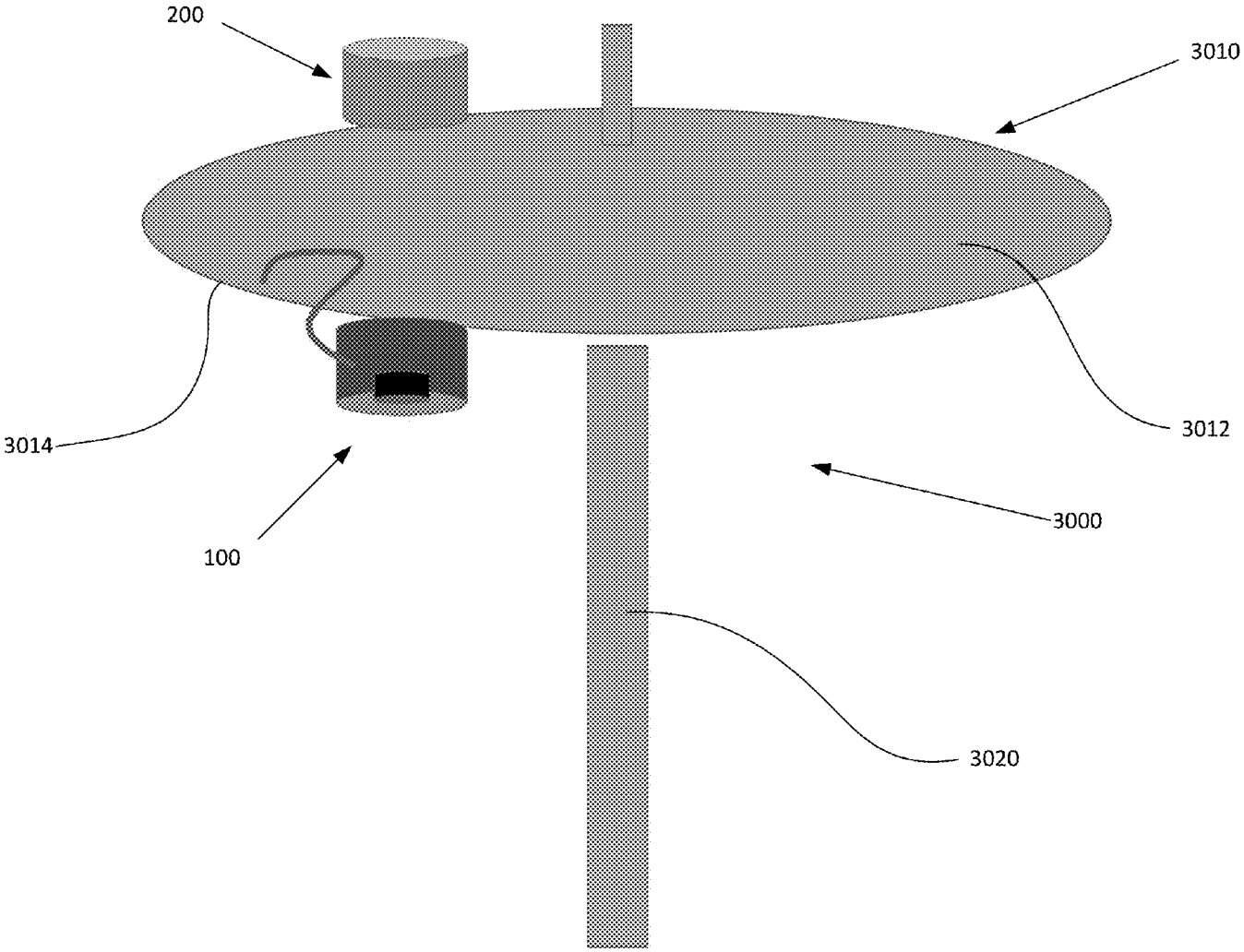
FIG. 16 provides a diagram of a trigger secured to a cymbal by a securing device according to the present invention.

With reference now to FIG. 16, a diagram of a trigger 100 secured to a cymbal 3010 by a securing device 200 according to the present invention is provided. The cymbal 3010 is disposed at the top of a cymbal assembly 3000 including a cymbal stand 3020. The cymbal 3010 may be a metal cymbal or may be a plastic or rubber practice cymbal. The trigger 100 works with any cymbal 3010 material composition. The securing device 200 is positioned on the top 3012 of the cymbal 3010 and the trigger 100 is disposed on the bottom 3014 of the cymbal 3010 opposite the securing device 200. Magnets in one or both of the securing device 200 and trigger 100 magnetically and releaseably secure the trigger 100 to the cymbal 3010. More than one trigger 100 may be placed on the cymbal 3010 to enable a player to play different cymbal sounds such as a bell sound or a crash sound on the body of the cymbal 3010. The trigger 100 does not experience crosstalk interference and therefore has no problems operating with additional triggers 100 on the cymbal 3010 when properly tuned using a module such as the electronic module 300 shown in FIG. 2.

With reference now to FIGS. 17A-17E, diagrams of a trigger 100 secured to a cymbal stand mount 3300 on a cymbal stand 3020 according to the present invention are provided. The cymbal stand mount 3300 may have one or more protrusions 3310 disposed on the body 3320 of the cymbal stand mount 3300 adapted to fit within the grommet 160 of the trigger 100. The protrusion 3310 may be comprised of a neodymium magnet or other ferromagnetic material such that the magnet 120 in the trigger 100 is magnetically attracted to the protrusion 3310. The cymbal stand mount 3300 may be placed anywhere on the cymbal stand 3020 of the cymbal assembly 3000. The position of the cymbal stand mount 3300 may be adjusted to provide optimal performance of the trigger 100.

Figures 17A, 17B, 17C, 17D, 17E:
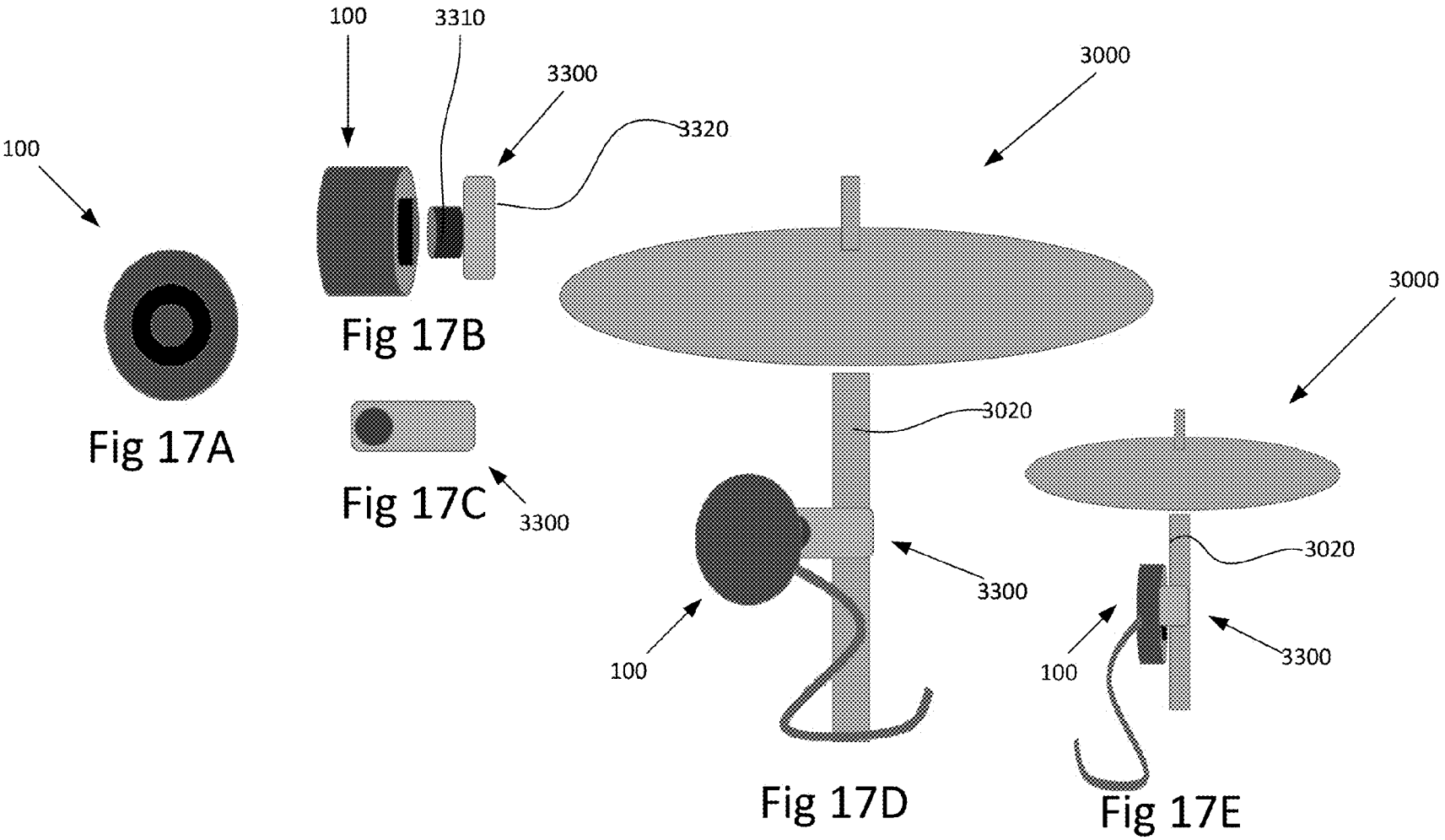
FIGS. 17A-17E provide diagrams of a trigger secured to a cymbal stand mount on a cymbal stand according to the present invention.

The cymbal choke assembly described above can be included to the embodiments described in FIGS. 17A-17B.

Figure 18:
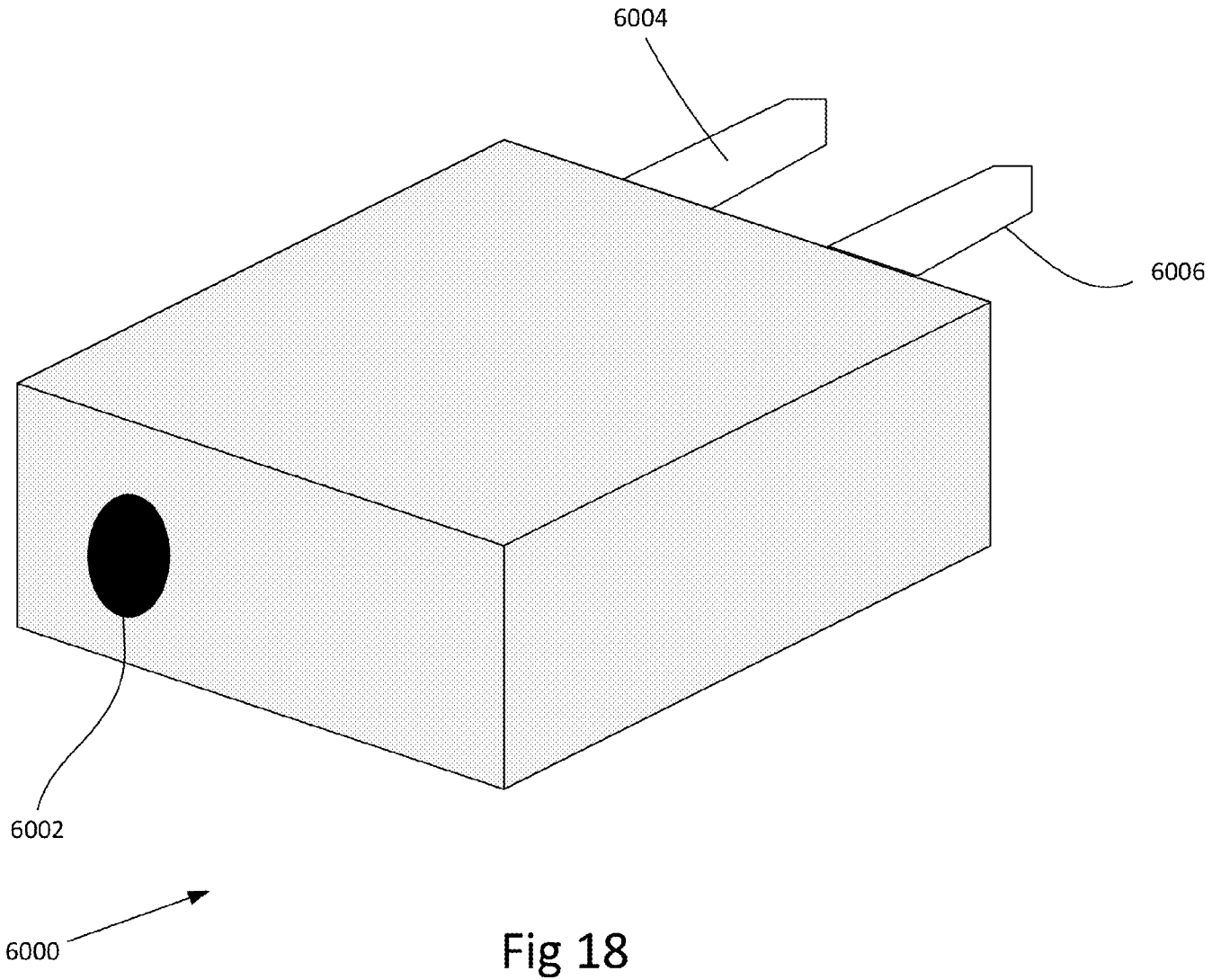
FIG. 18 provides a perspective view of a signal combination device for use with the trigger/choke combination in accordance with the present invention.

With reference now to FIG. 18, a perspective view of a signal combination device 6000 is provided. The signal combination device may have two or more inputs 6004 and 6006 and an output 6002. The signal combination device 6000 may be, for example, a conventional 3.5 mm audio adapter converter. The signal combination device 6000 enables multiple instrument triggers, such as trigger 100 shown in the various figures, to be connected to a single output 6002. When connected in this manner, the multiple triggers on a single instrument may act in one or separate but combinable configurations and may be individually or jointly configurable at a drum or instrument module. Particularly, the combination device 6000 may be used with a trigger and choke combination.

While the invention has been described by reference to certain preferred embodiments, it should be understood that numerous changes could be made within the spirit and scope of the inventive concept described. In implementation, the inventive concepts may be automatically or semi-automatically, i.e., with some degree of human intervention, performed. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. A choke and trigger apparatus, the trigger being magnetically mounted to a cymbal or cymbal stand and used to generate a signal derived from a vibration detected upon a user operating a cymbal, the choke and trigger apparatus comprising:
- a trigger adapted to be removably mounted onto a cymbal or cymbal stand and comprising:
  - a housing;
  - a magnet disposed and secured within the housing and adapted to removably secure the trigger to the cymbal or cymbal stand;
  - a piezo-electric transducer having an electrical output and being disposed within the housing, the piezo-electric transducer being electrically and physically isolated from the magnet and adapted to generate an electrical signal in response to a detected mechanical vibration associated with operation of the cymbal;
- a choke adapted to be mounted onto the cymbal or cymbal stand and to sense a touch of a hand for interrupting a signal associated with the electrical signal, the choke comprising:
  - a sensor disposed on the cymbal or cymbal stand and adapted to sense the touch of a user operating the cymbal
- and cause an electrical response to the sensed touching.

2. The apparatus of claim 1 further comprising a securing device, the securing device comprising a second housing and a second magnet disposed within the second housing, whereby with the trigger disposed opposite the securing device the respective magnets are attracted to each other with the cymbal disposed between the trigger and the securing device.

3. The apparatus of claim 1, wherein the trigger is further adapted to deliver the electrical signal to an input of an electronic drum module, the electronic drum module being adapted to process the trigger electrical signal and produce an audio signal representative of a sound associated with operation of a musical instrument.

4. The apparatus of claim 1 further comprising an electrical combination device adapted to be electrically connected to the trigger and to the choke and to generate an output representing the trigger electrical signal as unchoked and as choked.

5. The apparatus of claim 1 wherein the trigger magnet is a type of rare earth magnet.

6. The apparatus of claim 1 further comprising an electrical lead having a tip-ring-sleeve (TRS) jack, XLR connector, or a connector comprising a termination adapted to operatively connect to an electronic module.

7. The apparatus of claim 1 wherein the choke comprises a Force-Sensing Resistor sensor.

8. The apparatus of claim 1, wherein the choke is disposed on an edge of the cymbal.

9. A cymbal triggering system, the trigger being magnetically mounted to a cymbal or cymbal stand and used to generate a signal derived from a vibration detected upon a user operating a cymbal, the choke and trigger apparatus comprising:

a trigger adapted to be removably mounted onto the cymbal or cymbal stand and comprising:

a housing;

a magnet disposed and secured within the housing and adapted to removably secure the trigger to the cymbal or cymbal stand;

a piezo-electric transducer having an electrical output and being disposed within the housing, the piezo-electric transducer being electrically and physically isolated from the magnet and adapted to generate an electrical signal in response to a detected mechanical vibration associated with operation of the cymbal; and wherein the trigger is further adapted to deliver the electrical signal to an input of an electronic drum module;

a choke adapted to be mounted onto the cymbal or cymbal stand and to sense a touch of a hand for interrupting a signal associated with the electrical signal, the choke adapted to sense the touch of a user operating the cymbal and to cause an electrical response to the sensed touching to be transmitted to the drum module.

10. The system of claim 9, wherein the electronic drum module is further adapted to process the trigger electrical signal and produce an audio signal representative of a sound associated with operation of a musical instrument.

11. The system of claim 10, wherein the electronic drum module interrupts the production of the audio signal in response to the electrical response from the choke.

12. The system of claim 9, wherein the choke shorts the electrical signal from the trigger in response to the sensed touching.

13. The apparatus of claim 9, further comprising an electrical combination device adapted to be electrically connected to the trigger and to the choke and to generate an output representing the trigger electrical signal as unchoked and as choked.

14. The apparatus of claim 9, further comprising an electrical lead having a tip-ring-sleeve (TRS) jack, XLR connector, or a connector comprising a termination adapted to operatively connect to an electronic module.

15. The apparatus of claim 9, wherein the choke comprises a Force-Sensing Resistor sensor.

16. A cymbal choke for use in a cymbal triggering system having a trigger being removably magnetically mounted to a cymbal or cymbal stand, the cymbal choke comprising:

a sensor adapted to be mounted onto the cymbal or cymbal stand and to sense a touch of a hand for interrupting a signal associated with an electrical signal, the sensor further adapted to sense the touch of a user operating the cymbal and to cause an electrical response to the sensed touching to be transmitted to the drum module;

wherein the electrical signal is generated by the trigger removably magnetically mounted onto the cymbal or cymbal stand, the trigger comprising:

a housing;

a magnet disposed and secured within the housing and adapted to removably secure the trigger to the cymbal or cymbal stand;

a piezo-electric transducer having an electrical output and being disposed within the housing, the piezo-electric transducer being electrically and physically isolated from the magnet and adapted to generate the electrical signal in response to a detected mechanical vibration associated with operation of the cymbal; and wherein the trigger is further adapted to deliver the electrical signal to an input of an electronic drum module; and wherein the sensor shorts the electrical signal from the trigger in response to the sensed touching.

17. The system of claim 9, wherein the electronic drum module is further adapted to process the trigger electrical signal and produce an audio signal representative of a sound associated with operation of a musical instrument.

18. The system of claim 10, wherein the electronic drum module interrupts the production of the audio signal in response to the electrical response from the sensor.

19. The apparatus of claim 1 further comprising an electrical combination device adapted to be electrically connected to the trigger and to the choke and to generate an output representing the trigger electrical signal as unchoked and as choked.

* * * * *